United States Patent [19]

Caramaschi

[11] Patent Number: 5,038,836

[45] Date of Patent: Aug. 13, 1991

[54] NEEDLE HAVING AN OPENABLE EYE

[75] Inventor: Bruno Caramaschi, Blanquefort, France

[73] Assignee: Aerospatiale Societe Nationale Industrielle, Paris, France

[21] Appl. No.: 441,323

[22] Filed: Nov. 27, 1989

[30] Foreign Application Priority Data

Dec. 6, 1988 [FR] France ..... 88 15969

[51] Int. Cl.[5] ..... D03D 13/00; B64G 1/58; D05B 85/00

[52] U.S. Cl. ..... 139/11; 223/102

[58] Field of Search ..... 139/11, 380, 454; 223/102

[56] References Cited

U.S. PATENT DOCUMENTS 272,993 2/1883 Vieman ..... 223/102 X
658,508 9/1900 Redpath ..... 139/454

FOREIGN PATENT DOCUMENTS 2488291 8/1980 France .
2488292 8/1980 France .

*Primary Examiner*—Wm. Carter Reynolds
*Attorney, Agent, or Firm*—Martin Smolowitz

[57] ABSTRACT

The needle has an openable eye and is of use in a lacing stage of a tridimensional weaving of a composite reinforcement element, for driving out rigid rods and replacing them with loops of wire or thread. The needle has an axial aperture (13) at the end of the needle in the vicinity of the eye and the inner end of the aperture (13) is open and connected to the exterior through a passageway (14) which is oblique relative to the axis of the body of the needle (8) and laterally opens out through an orifice (15) in the vicinity of the eye (12), between the eye and the end of the needle.

3 Claims, 1 Drawing Sheet

NEEDLE HAVING AN OPENABLE EYE

BACKGROUND OF THE INVENTION

The present invention relates generally to the manufacture of composite reinforcement elements by multidirectional weaving or knitting, and more particularly relates to a lacing needle employed in the final stage of this manufacture.

Various multidirectional weaving or knitting methods are known. In one of the most common methods, a preform is constructed by placing a first series of parallel layers of wires, threads or fibres, on an assembly of detachable rigid rods perpendicular to the latter and interlaced therewith, a second series of layers of wires, threads or fibres perpendicular to the wires, threads of the first series of layers and to said rods and interlaced with the latter, said rods being thereafter driven out and replaced in succession by wires or threads introduced by means of one or more needles in an operation termed "lacing."

For the purpose of carrying out the last-mentioned operation, there are employed needles having an openable eye, for example of the type disclosed in FR-A-2,488,292.

These needles, which may be rectilinear or curved, advantageously comprise at their end in the vicinity of the eye, a blind axial aperture constituting a recess for receiving a spigot provided at the end of each rods. These rods are driven out axially by a thrust exerted by the needle when the latter enters the preform for depositing therein loops of wires or threads forming a third series of layers perpendicular to the first two layers.

When the needle has travelled through the whole of the preform, the rod driven out is released from the needle under the action of its own weight.

This system is particularly advantageous, since the interengagement between each rod and the needle ensures a perfect continuity of their assembly, in particular when the path through the preform is curved.

In its rectilinear or curved path, each needle travels first of all through the preform by driving a rod in front of the needle, then seizes a needleful of wire or thread, then rises through the preform by replacing the rod driven out with the wire or thread. When this replacement has terminated, the needle again descends in the preform through a few centimetres so as to release the needleful of wire or thread (loop release) and recommences a new travel in order to drive out and replace the following rod with a thread loop.

Experience has shown that, when the needle passes downwardly through the interlaced layers of wires, threads or fibres of the perform, the blind aperture of the end of the needle is completely filled with scraps of wires, threads or fibres which become compressed, and this has consequences of three kinds:

The spigot of the rod is unable to enter the aperture of the needle, and escapes right from the start so that the rod is blocked in the preform, which causes deformations and damage to the radial and circumferential wires or threads.

The needle only partly descends the rod which ends up by jamming in the preform, and this causes the same damages and deformations as in the preceding case.

The spigot manages to enter the aperture of the needle but is blocked by being gripped in the latter and the rod is unable to separate from the needle at the end of its downward travel.

In all cases, stoppage of the automatic knitting or weaving cycle occurs, and this requires the intervention of an operator with loss of time and defects in the finished element.

Furthermore, the life span of this finished element is considerably reduced owing to abnormal stresses and its replacement is consequently often necessary.

SUMMARY OF THE INVENTION

An object of the invention is therefore to overcome these drawbacks by providing a needle of the aforementioned type, whose axial aperture at its end cannot become filled with scraps of fibres and cannot be obstructed, thereby permitting a perfect coupling of the rod with the needle and consequently a sure release of the rod after the preform has been travelled through the element.

The invention therefore provides a needle having an openable eye and adapted to be employed in the lacing stage of the tridimensional weaving of a composite reinforcement element, for driving out rigid rods and replacing them with wire or thread loops, the needle comprising a body portion having a longitudinal axis and a blind axial aperture at a first end of the needle in the vicinity of the eye, wherein the inner end of said aperture is open and connected to a passageway which is oblique relative to the body portion of the needle and opens out laterally through an orifice in the vicinity of the eye, between the eye and the end of the body of the needle.

According to another feature of the invention, the oblique passageway makes an angle of between 30° and 90° with the longitudinal axis of the body of the needle. Preferably, said angle is about 45°.

The following description, with reference to the accommpanying drawings given by way of non-limitative examples, will explain how the invention may be carried out.

DESCRIPTION OF THE PREFERRED EMBODIMENTS

Figure 1:
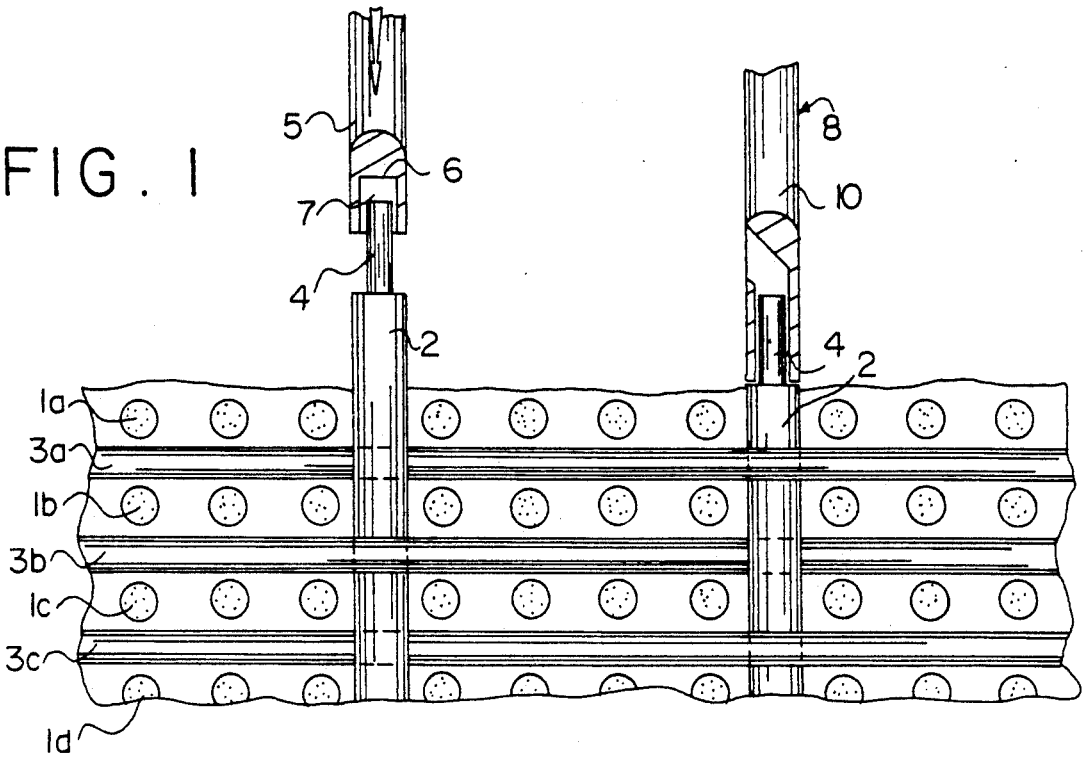
FIG. 1 is a diagrammatic view of the arrangement of the layers of wires or threads and rods in the tridimensional weaving of a composite reinforcement element, and showing the ends of needles having an openable eye engaged with the ends of said rods for the purpose of driving them out and replacing them with loops of wire or threads, the needles shown in the left part of the Figure being a conventional needle having a blind axial aperture, and the needle shown in the right part being a needle according to the invention.

With reference to FIG. 1, the reference characters 1*a*, 1*b*, 1*c*, 1*d* designate a first series of layers of wires, threads or fibres, arranged in an interlaced manner about rigid rods 2 and perpendicular to the latter in a first direction, and the reference characters 3*a*, 3*b*, 3*c* designate a second series of layers of wires, threads or fibres arranged perpendicular to said rods, in a second direction.

In the known manner, each rigid rod 2 has a lower end (not shown) detachably fixed to a support (not shown) and an upper end having a portion of reduced diameter or spigot 4.

With reference to the left part of FIG. 1, there is shown a conventional needle 5 having an openable eye of known type, with, at the end, in the vicinity of the eye, a blind axial aperture 6 adapted to cooperate with the spigot 4 of each rod 2. The rod 2 is engaged in this aperture 6 generally upon each downward travel of the needle 5 through the layers of wires or threads 1*a*, 1*b*, 1*c*, 1*d*. . . etc. and the layers 3*a*, 3*b*, 3*c*. . . etc., in such manner that the needle drives out the corresponding rod 2 and deposits, in rising, a loop of wire which is adapted to replace said rod and is seizes by the openable eye, in the known manner.

It has been found that, in the course of each passage of the needle 5 through the layers of wires or threads, the blind aperture 6 gradually becomes filled with scraps of wires, threads or fibrils which become packed in the inner end of the aperture, as shown at 7 when the blind aperture becomes filled, the spigot 4 of the rod can no longer enter this aperture, the coupling of the needle 5 with the rod 2 is insufficient, and the aforementioned incidents frequently occur.

Figure 3:
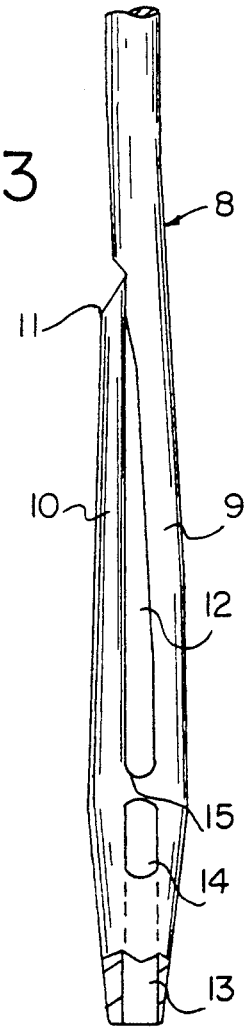
FIG. 3 is a similar partial view taken at 90° angle at lines 3—3 of FIG. 2.
Figure 2:
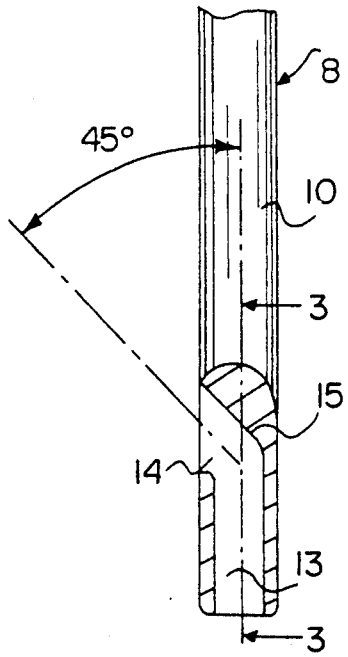
FIG. 2 is a partial view, with a part cut away, of the needle showing an oblique passageway connecting the inner end of the aperture to the exteroir.

With reference to the right part of FIG. 1 and to FIGS. 2 and 3, the reference character 8 designates an improved needle according to the invention.

In the illustrated embodiment, the needle 8 is a needle having an openable eye of the type disclosed in FR-A-2,488,292, whose body is curved in its end part so as to form an elastic strip 10 whose free end 11 is normally applied against the body for forming the eye 12 of the needle, and the end of the body in the vicinity of the eye includes an axial aperture 13.

According to the invention, the inner end of the axial aperture 13 is connected to the needle exterior through a passageway 14, which is oblique relative to the axis of needle body and opens out laterally on a single side of the needle relative to the eye 12 through an orifice 15.

This oblique passageway ensures a constant evacuation of the fibrils which may accumulate in the aperture 13 as they enter the latter.

After various test, the applicant found that, if the angle the passageway 14 makes with the axis of the body of the needle was about 90°, the fibrils were evacuated with difficulty and that, if this angle was about 30°, the fibrils were easily evacuated but the strength of the needle was dangerously reduced. These tests have shown that the optimal angle for passageway 14 for ensuring both a satisfactory evacuation of the fibrils and an avoidance of the weakening of the strength of the needle was about 45° with the longitudinal axis of the needle 8.

The orifice 15 which is located between the eye 12 and the first or lower end of the needle, opens onto one side, preferably in the direction perpendicular to the direction of the opening of the eye 12.

It has been found that the aperture is easily machined and may therefore be machined in existing needles.

Although the invention has been described in its application to a needle having an openable eye of the type disclosed in FR-A-2,488,292, it will of course be understood that it is also applicable to needles having an openable eye of any other types which are used both in the manufacture of composite reinforcement elements and in any other work.

What is claimed is:

1. Needle comprising a body portion having a longitudinal axis and an openable eye adjacent to a first end of the needle, said needle being for use in a lacing stage of a tridimensional weaving of a composite reinforcement element, for urging out rigid rods and replacing the rods with loops of wire, said needle further comprising an aperture axially extending inwardly from said first end of the needle, said aperture having an inner end, and a passageway oblique realtive to said axis connecting the inner end of the aperture to the exterior of needle, the passageway laterally opening out through an orifice in the needle in the vicinity of the eye, between the eye and said first end of the needle.

2. Needle according to claim 1, wherein said oblique passageway makes an angle of between 30° and 90° with said longitudinal axis.

3. Needle according to claim 2, wherein said angle is about 45°.

* * * * *